United States Patent [19]

Smrt

[11] 4,262,821

[45] Apr. 21, 1981

[54] MARKING APPARATUS

[76] Inventor: Thomas J. Smrt, 172 S. Northwest Hwy., Cary, Ill. 60013

[21] Appl. No.: 27,362

[22] Filed: Apr. 5, 1979

[51] Int. Cl.[3] ..... E01C 23/16; B05B 13/00

[52] U.S. Cl. ..... 222/162; 222/174; 222/609; 222/612; 118/305; 239/172

[58] Field of Search ..... 222/162, 174, 609, 612; 239/150, 172, 578; 118/305; 401/190

[56] References Cited

U.S. PATENT DOCUMENTS

| | | | |
|---|---|---|---|
| 3,229,859 | 1/1966 | Conroy et al. | 222/174 |
| 3,540,632 | 11/1970 | Clingan | 222/612 X |
| 3,794,217 | 2/1974 | Munchel | 222/174 |
| 4,099,482 | 7/1978 | Smrt | 118/305 X |
| 4,126,273 | 11/1978 | Smrt | 239/579 |

FOREIGN PATENT DOCUMENTS

| | | |
|---|---|---|
| 1185529 | 3/1970 | United Kingdom . |
| 1456411 | 11/1976 | United Kingdom . |

*Primary Examiner*—Robert J. Spar
*Assistant Examiner*—Frederick R. Handrem

[57] ABSTRACT

A marking apparatus includes a wheel-equipped base and a handle for pushing the base. A can holder is adjustably mounted on the handle for holding a can of marking material. The can holder includes a stop plate which engages the actuator of the can and through which the marking material is sprayed. A trigger rod is movably mounted on the handle for pushing the can toward the stop plate for opening the valve of the can.

9 Claims, 10 Drawing Figures

MARKING APPARATUS

BACKGROUND AND SUMMARY

This invention relates to marking apparatus, and, more particularly, to marking apparatus which utilizes an aerosol can of marking material.

This invention is a variation of marking machines or paint stripers described in my previous patents—U.S. Pat. Nos. 3,485,206, 3,700,144, 3,796,353, 3,817,429, 3,871,557, and 4,126,273. In particular, the invention relates to a marking machine which is cheaper than the devices described in the foregoing patents but which is easy to assemble and operate and which makes well-defined stripes of variable width.

DESCRIPTION OF THE DRAWING

The invention will be explained in conjunction with an illustrative embodiment shown in the accompanying drawing, in which.

DESCRIPTION OF SPECIFIC EMBODIMENTS

Figure 1:
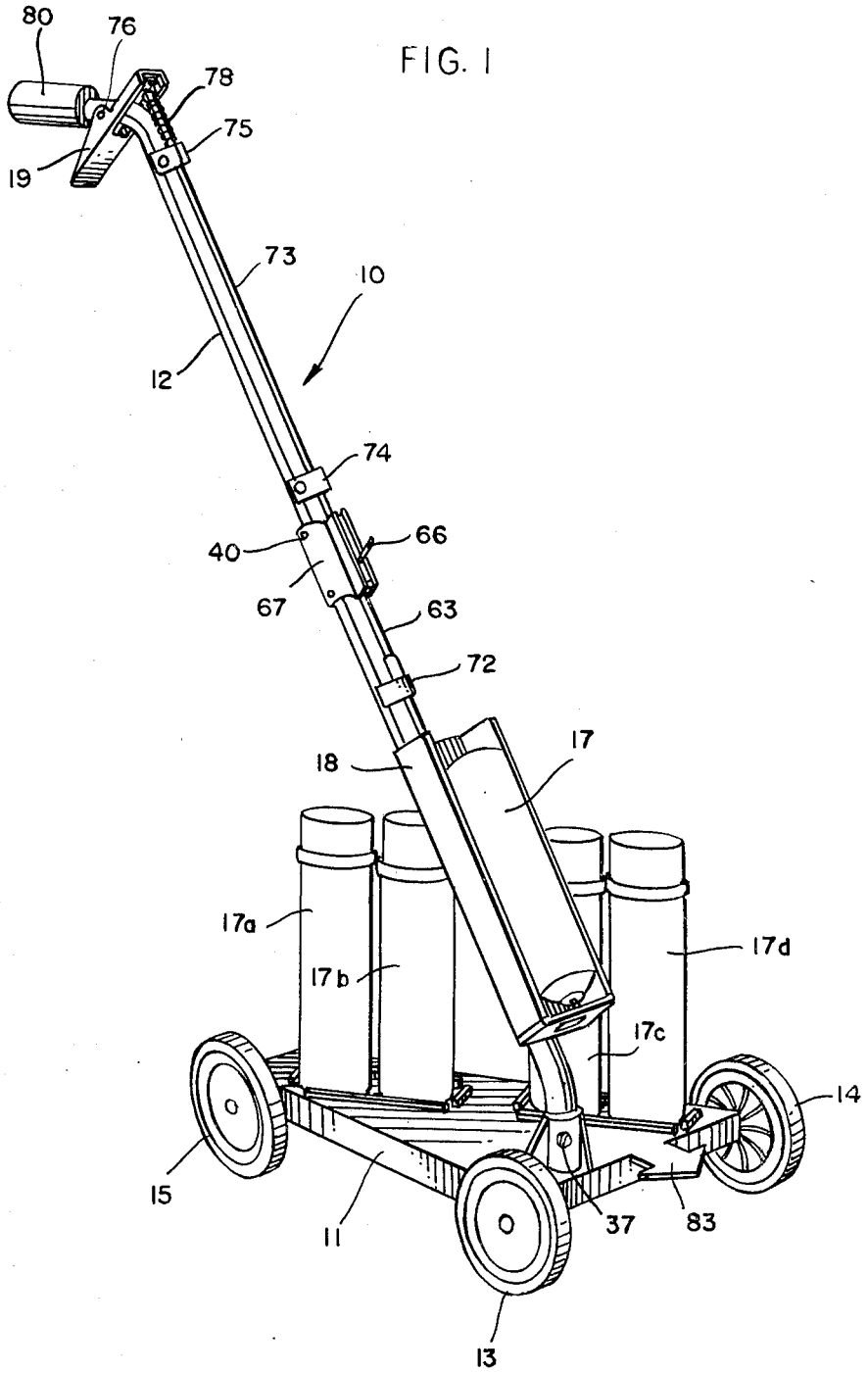
FIG. 1 is a perspective view of a marking apparatus formed in accordance with the invention.

The numeral 10 designates generally a marking apparatus which includes a base 11 and a handle 12. The base is supported by a pair of front wheels 13 and 14 and a pair of rear wheels 15 and 16. An aerosol spray can 17 containing paint or other marking material is supported by a can holder 18 on the handle, and the apparatus is operated by a trigger 19 on the upper end of the handle.

Figure 2:
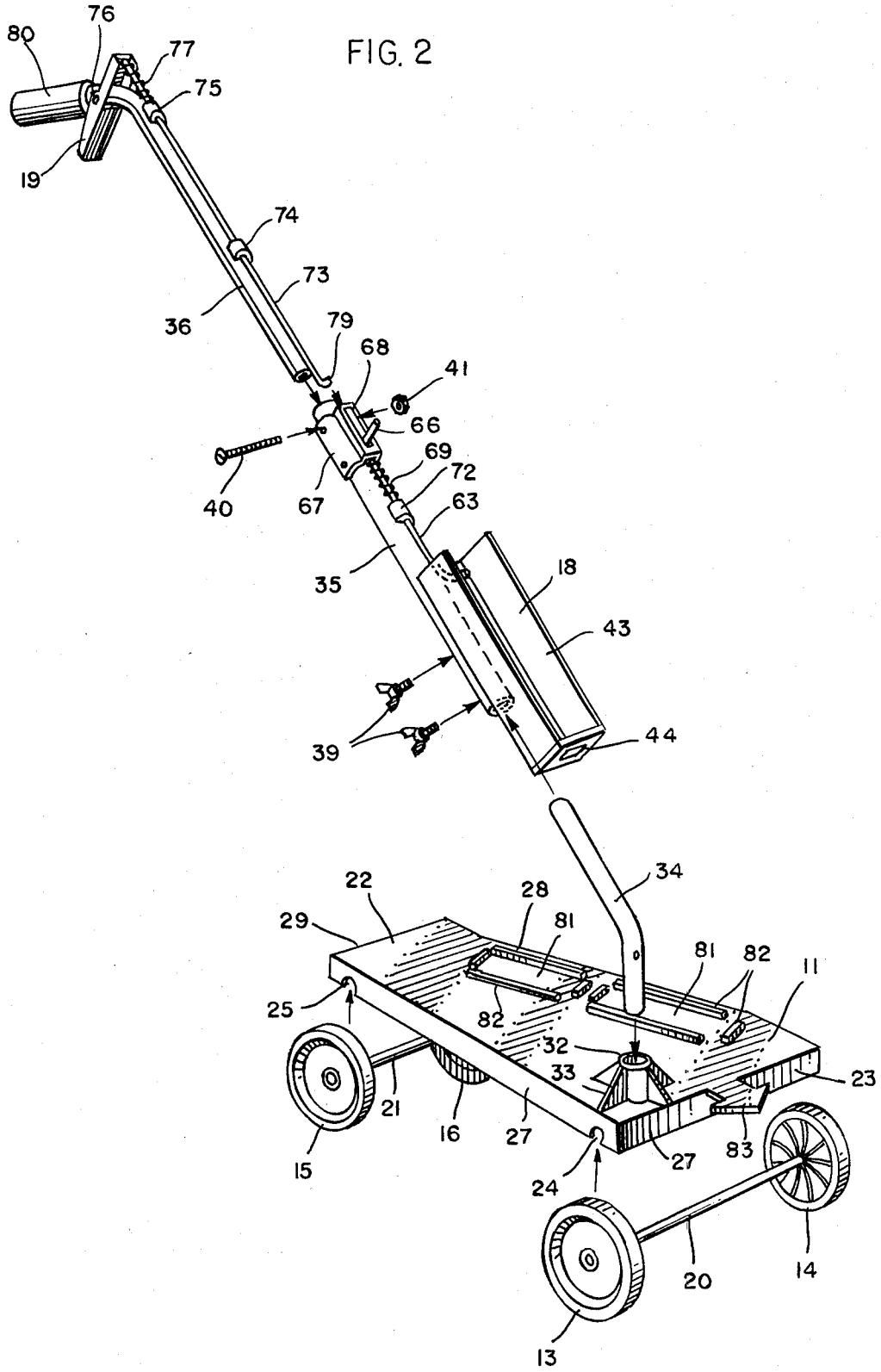
FIG. 2 is an exploded perspective view of the marking apparatus.

Referring to FIG. 2, the front wheels are mounted on a front axle 20, and the rear wheels are mounted on a rear axle 21. The base 11 is advantageously injection molded from plastic and includes a flat, generally triangularly shaped central portion 22 and a depending perimetric flange 23. A pair of front and rear axle slots 24 and 25 are formed in the flange on each side of the base, and the slots are sized so that the axles can be snapped into the slots and retained therein until sufficient force is exerted on the axles to withdraw them from the slots.

The right side 26 of the base extends perpendicular to the front side 27, and the left side 28 converges toward the right side so that the rear side 29 is shorter than the front side. The spacing between the rear wheels is therefore relatively small so that the operator can walk behind the apparatus without stepping on the rear wheels. However, the rear wheels are spaced apart sufficiently that they do not track over the stripe of marking material that is sprayed by the aerosol can. Spacer sleeves or the like can be mounted on the rear axle to increase the spacing between the rear wheels and to prevent the left rear wheel from engaging the left side 28 of the base.

Figures 3, 4, 5, 6, 7, 8, 9, 10:
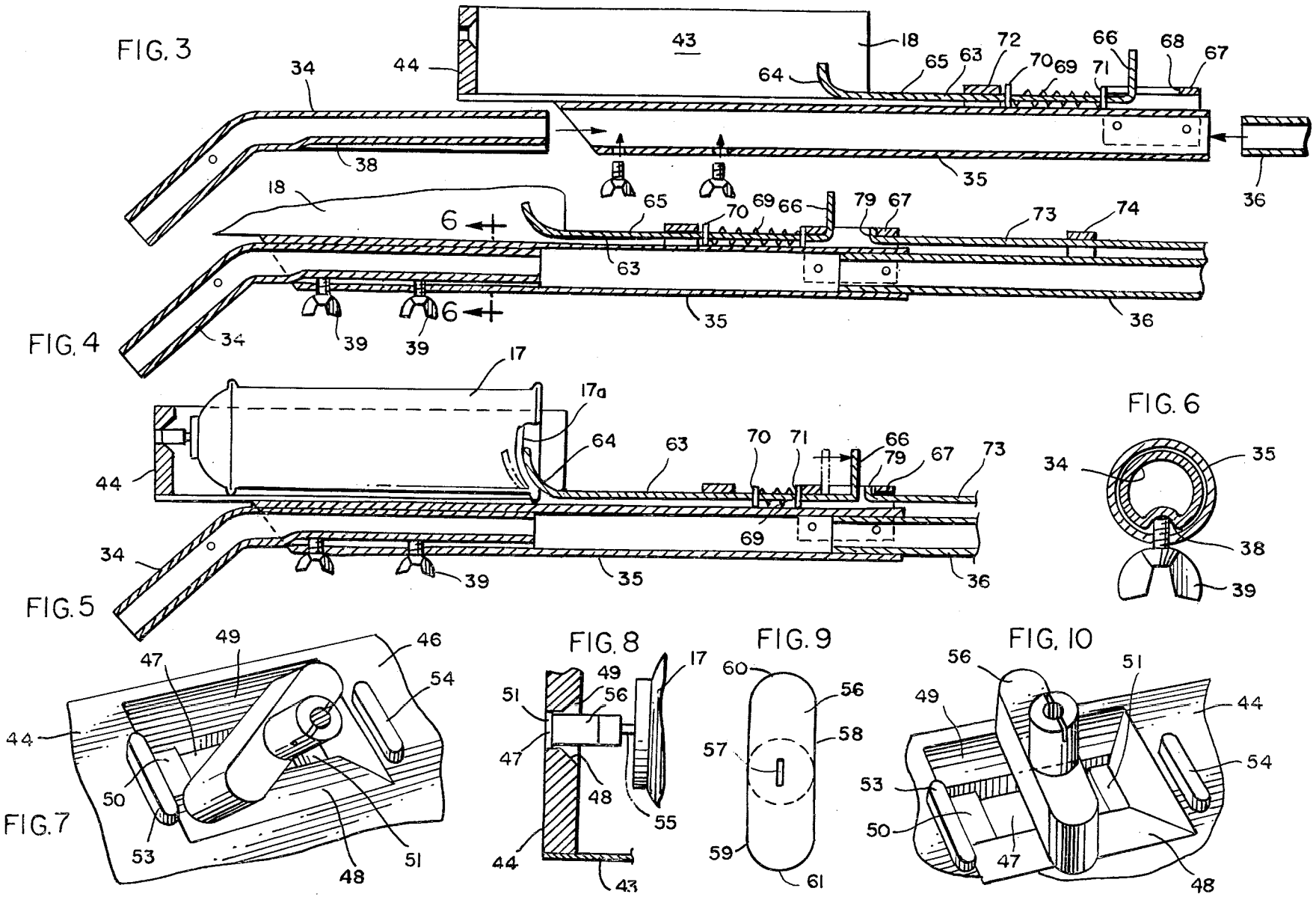
FIG. 3 is a longitudinal, fragmentary, exploded sectional view of the handle of the marking apparatus.
FIG. 4 is a fragmentary longitudnal sectional view of the handle.
FIG. 5 is a fragmentary sectional view of the handle showing a can of marking material mounted in the can holder.
FIG. 6 is a sectional view taken along the line 6—6 of FIG. 4.
FIG. 7 is a fragmentary perspective view of the stop plate of the can holder and the actuator of the can.
FIG. 8 is an enlarged fragmentary sectional view showing the engagement between the actuator and the stop plate of the can holder.
FIG. 9 is a planned view of the actuator of the can.
FIG. 10 is a perspective view similar to FIG. 7 showing the stop plate blocking insertion of the actuator.

A handle attaching sleeve 32 is formed on the right front corner of the base and is reinforced by ribs 33. The handle includes three detachable sections—a lower handle 34, a middle handle 35, and an upper handle 36. The lower handle 34 is somewhat V-shaped and is secured within the attaching sleeve 32 by a screw 37 (FIG. 1) which extends into a hole in the lower handle. The upper portion of the lower handle is formed to provide a groove 38 (see FIGS. 3 and 6). The middle handle telescopes over the upper end of the lower handle and is secured thereto by a pair of wing screws 39 which engage the groove 38 (FIGS. 4 and 6). The upper handle fits into the middle handle and is secured by a bolt 40 which is insertable through openings in the middle and upper handles when the openings are aligned. A nut 41 prevents the bolt from being withdrawn.

The box-shaped can holder 18 is attached to the middle handle 35. The can holder is formed by a channel-shaped piece of sheet metal 43 and a plastic base plate or stop plate 44. The sheet metal channel is spot welded or otherwise suitable secured to the middle handle, and the stop plate may be secured by tabs on the channel which extend through slots in the stop plate and are bent over.

Referring to FIGS. 7 and 8, the stop plate 44 includes a flat upper surface 46, a rectangular spray opening 47, and a pair of inclined guide walls 48 and 49 which converge downwardly from the upper surface toward the opening. The side portions of the guide walls merge with a pair of flat stop walls 50 and 51 which define the side of the rectangular opening. A pair of elongated ribs 53 and 54 extend upwardly from the upper surface 46.

The aerosol can is not equipped with a dip tube, so the contents of the can are sprayed when the can is inverted. The aerosol can includes a conventional valve which is opened when the valve stem 55 (FIG. 8) is pushed. Any conventional propellant can be used to expel the contents of the can when the valve is open. The stop plate of the can holder is designed for use with an actuator 56 of the type described in my prior U.S. Pat. No. 3,817,429. The actuator includes an elongated spraying orifice 57 (FIG. 9) and a pair of flat side surfaces 58 and 59 which extend parallel to the long axis of the spraying orifice. A pair of curved end walls 60 and 61 extend between the side surfaces.

FIG. 7 illustrates the way in which the inclined guide surfaces 48 and 49 guide the actuator into the proper spraying position. The planes of both guide surfaces extend perpendicularly to the direction in which the marking apparatus is rolled over the surface to be marked. If the can is inserted into the can holder with the flat sides 58 and 59 slightly askew from a line extending perpendicularly to the direction in which the apparatus moves, the ends of the actuator will engage the guide surfaces, and the weight of the can will cause the actuator and the can to rotate until the actuator drops into engagement with the flat stop surfaces 50 and 51. In this position the long axis of the rectangular spraying orifice 57 will be perpendicular to the direction in which the marking apparatus moves, and the width of the stripe sprayed by the can will be at a maximum with sharp, well-defined edges.

FIG. 10 illustrates the way in which the stop plate prevents the actuator from being inserted if the actuator is aligned substantially parallel to the direction of movement.

A lower trigger rod 63 is slidably mounted on the middle handle 35 adjacent the upper end of the can holder. The lower trigger rod includes a curved lower end 64 (FIGS. 3–5) which is adapted to engage the conventional concave bottom of the aerosol can, a straight middle portion 65 which extends parallel to the handle, and a perpendicular upper end portion 66. A plastic guide block 67 is attached to the middle handle and is provided with an elongated slot 68 (FIGS. 2 and 3) through which the end portion 66 of the lower trigger rod extends. A coil spring 69 on the lower trigger rod is compressed between a washer 70 secured to the trigger rod and a washer 71 which is slidably mounted on the trigger rod and which is pressed against the lower end of the guide block by the spring. A guide 72 is secured to the middle handle below the washer 70.

When an aerosol can is not inserted in the can holder, the upper end of the lower trigger rod engages the bottom of the slot 68 in the guide block. The can may be inserted into the holder by moving the upper end 66 of the trigger rod toward the top of the slot in the guide block 67 to permit the can to clear the lower end of the trigger rod. If the actuator is positioned as in FIG. 10, the can cannot be moved past the lower end of the trigger rod until the actuator is rotated so that it engages the sloping guide walls 48 and 49 of the stop plate. This insures that the actuator will always have its spraying orifice properly positioned. After the can is inserted, the trigger rod is released, and the curved lower end 64 of the rod will be forced into the concave bottom of 17*a* of the can by the spring 69 as shown in FIG. 5. The force of the spring holds the can securely in the can holder and prevents inadvertent dislodgement of the can while the apparatus is rolled over the surface.

An upper trigger rod 73 is slidably mounted on the upper handle 36 by a pair of plastic guides 74 and 75 (FIGS. 1 and 2) which are secured to the upper handle. The upper end of the upper trigger rod is engagable with the trigger 19, which is pivotally secured to the handle by a bolt 76. A coil spring 77 is compressed between the upper guide 75 and the upper end of the trigger rod 73, and the upper trigger rod and the trigger are resiliently biased upwardly to the position illustrated in FIGS. 1 and 2. The lower end 79 (see also FIGS. 4 and 5) of the upper trigger rod 73 is bent perpendicularly outwardly and is insertable into the upper end of the guide block 67 when the upper handle is inserted into the middle handle. The bolt 40 which secures the middle and upper handles together also secures the upper end of the guide block. Accordingly, until the bolt is inserted, the top of the guide block can be pulled away from the handle to facilitate insertion of the lower trigger rod into the guide block. A hand grip 80 (FIGS. 1 and 2) covers the upper end of the handle.

The base 11 is provided with a pair of rectangular areas 81 (FIG. 2), each of which is outlined by four orthogonally related raised ribs 82. Each rectangle is sized to receive and snuggly grip the bottoms of two aerosol cans arranged side-by-side so that a total of four extra aerosol cans 17*a–d* may be carried on the marking apparatus as illustrated in FIG. 1. A guide arrow 83 is molded intergrally with the base and assists the operator in following a chalk line, old stripe, etc. for making a straight line.

The marking apparatus can be transported or stored in a knocked-down condition in which the apparatus occupies a very compact space. When the apparatus is to be used, it can be quickly assembled merely by snapping the wheel axles into the slots in the base and attaching the three handle sections. The lower trigger rod 63 is raised, and an aerosol is inserted into the can holder. The actuator is guided into its proper perpendicular position by the inclined guide walls 48 and 49 on the stop plate, and when the lower trigger rod is released, the spring 69 holds the can in place. The tension of the spring 69 is such that the can is held in place but is not depressed toward the stop plate to open the can valve.

The marking material is released by squeezing the trigger 19. This moves the upper trigger rod 73 downwardly, and the lower end of the upper trigger rod eventually engages the upper end of the lower trigger rod 63. Further downward movement of the upper trigger rod forces the lower trigger rod and the aerosol can downwardly toward the stop plate of the can holder. Since the actuator is prevented from moving by the stop surfaces 50 and 51 of the stop plate, the aerosol can is moved downwardly relative to the valve stem 55 of the can valve, and the valve is opened. The marking material is sprayed through the rectangular spraying orifice of the actuator, through the opening in the stop plate, and onto the surface over which the marking apparatus is rolled. The raised ribs 53 and 54 (FIG. 7) on the stop plate are engagable with the rim or bead of the can which surrounds the valve opening and prevents the can from being forced downwardly far enough to damage the valve.

The handle of the marking apparatus is attached to the base near the right front corner, and the stripe of marking material will be laid down near the right wheels. However, the right wheels are spaced laterally from the stripe sufficiently to avoid tracking over the stripe. The left rear wheel 16 is inset laterally to facilitate walking behind the stripe but is spaced from the right wheel sufficiently to avoid tracking.

Since the aerosol can sprays the marking material downwardly and forwardly in line with the inclined handle, the spray hits the surface forwardly of the base and the wheels. This enables the marking apparatus to spray a stripe right up to a wall, curve, etc. without interference from the marking apparatus. The close proximity of the stripe to the right wheels of the apparatus also permits the stripe to be located very close to a wall, curve, etc. on the right side.

The width of the stripe being sprayed on the surface can be varied by adjusting the position of the middle handle 35 on the lower handle 34. If a wider stripe is desired, the wing screws 39 are loosened, and the middle handle is raised relative to the lower handle. This elevates the can holder and the aerosol can relative to the surface and, because of the divergence of the spray, increases the width of the stripe. If a narrower stripe is desired, the middle handle 35 is lowered relative to the lower handle.

Although the marking apparatus is most conveniently used when the handle is attached to the base so that the apparatus can be rolled over the surface to be marked, the marking material can be sprayed even when the handle is detached from the base by removing the screw 37 which secures the lower end of the handle to the base. The marking apparatus could then be operated in a fashion similar to the marking apparatus described in my prior U.S. Pat. No. 3,485,206. The handle can be carried in one hand, and when marking material is to be sprayed, the trigger is squeezed.

While in the foregoing specification a detailed description of a specific embodiment of the invention was set forth for the purpose of illustration, it will be understood that many of the details herein given may be varied considerably by those skilled in the art without departing from the spirit and scope of the invention.

I claim;

1. A marking apparatus adapted for use with a can containing marking material, the can having a valve for releasing the marking material and a valve actuator mounted on the valve, the apparatus comprising a base, wheels mounted on the base for permitting the base to be rolled over a surface to be marked, a handle attached to the base and extending upwardly therefrom, a can holder mounted on the handle for holding said can, the can holder having actuator stop means for engaging the valve actuator of the can and preventing movement thereof, a trigger rod movably mounted on the handle and engageable with the can for moving the can toward the actuator stop means whereby the valve of the can is opened to release the marking material, the trigger rod including a lower end portion engageable with the can, an intermediate portion which extends generally parallel with said handle, and an upper end portion which extends generally perpendicularly to said handle, and a spring resiliently biasing said lower end portion toward said actuator stop means, whereby said lower end portion of the trigger rod can be moved away from the actuator stop means against the bias of the spring by raising said upper end portion of the trigger rod to permit said can to be inserted between the actuator stop means and the lower end portion of the trigger rod.

2. The apparatus of claim 1 in which the actuator has an elongated spraying orifice and the actuator stop means includes a pair of converging walls which extend generally perpendicular to the direction in which the marking apparatus is rolled and which are engagable with the actuator to align the elongated spraying orifice in a direction perpendicular to the direction in which the marking apparatus is rolled.

3. The apparatus of claim 1 including an upper trigger rod movably mounted on the handle and engagable with said first-mentioned trigger rod for moving the first-mentioned trigger rod toward said actuator stop means.

4. The apparatus of claim 3 including a trigger pivotally mounted on the upper end of the handle for moving the upper trigger rod toward the first-mentioned trigger rod.

5. The apparatus of claim 1 in which said handle includes a first handle portion attached to said base and a second handle portion attached to the first handle portion, the can holder being mounted on the second handle portion, the second handle portion being adjustable along the length of the first handle portion whereby the distance of the can from the surface to be marked can be adjusted to vary the width of the marking material being sprayed on the surface.

6. The apparatus of claim 5 including a third handle portion attached to the second handle portion, said trigger rod comprising a lower trigger rod movably mounted on the second handle portion and an upper trigger rod movably mounted on the third handle portion and engagable with the lower trigger rod.

7. The apparatus of claim 6 in which the actuator has an elongated spraying orifice and the actuator stop means includes a pair of converging walls which extend generally perpendicularly to the direction in which the marking apparatus is rolled and which are engagable with the actuator to align the elongated spraying orifice in a direction perpendicular to the direction in which the marking apparatus is rolled.

8. The apparatus of claim 1 including a pair of axles removably mounted on the base and a pair of wheels mounted on each axle.

9. The apparatus of claim 8 in which one of the axles is shorter than the other axle and said base is generally triangularly shaped.

* * * * *